United States Patent [19]

Kessler et al.

[11] Patent Number: 4,753,359

[45] Date of Patent: Jun. 28, 1988

[54] TAMPER-PROOF CAP AND BOTTLE

[75] Inventors: Milton Kessler; Myron Ullman, both of Youngstown, Ohio

[73] Assignee: Boardman Molded Products, Inc., Youngstown, Ohio

[21] Appl. No.: 112,704

[22] Filed: Oct. 26, 1987

Related U.S. Application Data

[63] Continuation-in-part of Ser. No. 58,679, May 26, 1987.

[51] Int. Cl.[4] ..... B65D 41/34

[52] U.S. Cl. ..... 215/252

[58] Field of Search ..... 215/232, 252

[56] References Cited

U.S. PATENT DOCUMENTS 4,592,475 6/1986 Hannon ..... 215/252

*Primary Examiner*—Donald F. Norton

*Attorney, Agent, or Firm*—Browdy and Neimark

[57] ABSTRACT

A tamper-proof bottle is provided with a tamper-proof closure including an internally threaded "top-hat" cap having a tear-away portion and an annular snap rim welded to the bottom of the cap flange, the annular snap rim snap-fitting over the neck rib of the bottle.

12 Claims, 2 Drawing Sheets

TAMPER-PROOF CAP AND BOTTLE

FIELD OF THE INVENTION

This is a continuation-in-part of parent co-pending application Ser. No. 058,679 in the name of Milton Kessler, filed May 26, 1987.

The present invention relates to tamper-proof caps or closures of the tear-away type, particularly useful in conjunction with pharmaceutical containers for materials intended for consumption such as pharmaceuticals, and more particularly to the caps and the sealed bottles.

BACKGROUND OF THE INVENTION

Due to the increasingly high occurrence of tampering with pharmaceutical containers and the like, particularly before purchase by the consumer, many attempts in recent years have been directed towards producing tamper-proof closures or caps which would signal or alert potential consumers that tampering or unauthorized access of the containers has transpired. The common use of incorporating tear-away strip caps have been increasingly employed; these caps, when opened, conveniently leave broken cap strips, thus very clearly alerting a customer to the fact that tampering of the closure has occurred.

It is known to weld or seal a portion of a cap directly to a part of a cap-abuttment or cap-seating flange or neck of the container to seal the cap to the container. When the cap is then removed, a portion below or adjacent the sealed portion may remain with the container while the remainder of the cap is removed. This allows for the cap, upon a hand turning force exerted thereon, to break off via for example a weakened portion, so that a portion of the cap becomes an integral non-removable portion of the container. For example, U.S. Pat. Nos. 3,525,454 to Fredericksen; 3,788,509 to Keeler; 3,851,783 to Braginetz; 4,011,961 to Widen et al; 4,207,988 to Provty et al; and 4,494,663 to Bertard et al all disclose tamper-proof caps or closures which are heat sealed or ultrasonically welded directly to the container flange or neck.

However, some of these above-mentioned patents require weld rings between the cap and the container to ensure a proper sealing of the cap and container when the heat sealing or ultrasonic generating apparatus are placed thereabout, thereby increasing the time and cost of manufacturing the sealed container. Furthermore, welding of the cap may only be completed in the internal regions where the cap abuts the container, thereby allowing the premature dislodgement of the cap from the container. Additionally, all of these prior art proposals require the necessity of large cumbersome apparatus to accomplish sealing of the cap to container, thereby providing slow and expensive production of the capped containers.

In the aforementioned Keeler U.S. Patent, a spot welder is repeatedly reciprocated (see FIG. 3); this is not a practical solution, as it is too slow for commercial production. The aforementioned patents do not specify with sufficient particularity how to precisely obtain their seals, and furthermore such patents all relate to non-screw closures of particular and intricate construction which cannot be used in conjunction with the typical "top-hat" style screw cap. The same is true of the construction of the Fredericksen U.S. Pat. No. 3,525,454.

No tamper-proof screw cap or closure of the "top hat" variety for use on pharmaceutical containers has previously been available which can be quickly and inexpensively provide a tamper-proof container. In addition, there is a great need for a tamper-proof container using a simple but effective closure which can be separately made and attached to the container with ease, simple equipment, quickly, inexpensively and with expediency while assuring a permanent and effective seal.

RELATED INVENTION

Related subject matter, of which the present invention constitutes a variation and/or an improvement, is set forth in co-pending application Ser. No. 058,679 filed May 26, 1987.

While the subject matter of the aforementioned parent application provides an excellent solution to many of the problems outlined, it does require a non-standardized bottle or container, i.e. one with a larger than normal cap-abutting neck flange, and one which is either plastic or coated with plastic. The improvement of the present invention, on the other hand, can be used with standard bottles of either glass or plastic.

SUMMARY OF THE INVENTION

Accordingly, it is an object of the present invention to overcome the deficiencies of the prior art, such as those set forth above; and it is another object to provide for the improved sealing of tamper-proof screw caps to bottles.

It is still another object of the present invention to provide an improved tamper-proof container.

It is a further object of the present invention to provide an improved tamper-proof bottle with screw cap or closure sealed thereto.

It is yet a further object of the present invention to provide an improved tamper-proof cap of the screw "top hat" style which will lock to a conventional bottle in a tamper-proof way.

It is yet another object of the present invention to provide a "top hat" style tamper-proof cap having welded thereto a sealing element which will interlock with the conventional neck lip of a conventional bottle to provide a tamper-proof package.

Still other objects, features and attendant advantages of the present invention will become apparent to those skilled in the art from a reading of the following detailed description of embodiments of the invention taken in conjunction with the accompanying drawings, wherein:

BRIEF DESCRIPTION OF THE DRAWINGS

FIG. 4 B is a plan view of the annular snap ring of FIG. 4 A;

DESCRIPTION OF PREFERRED EMBODIMENT

Figure 1:
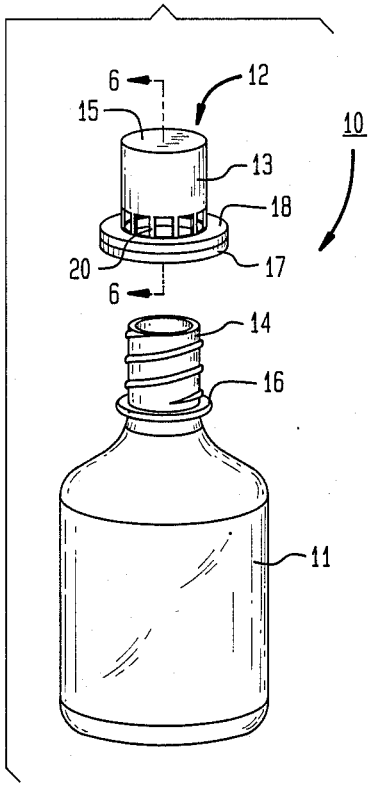
FIG. 1 is an exploded perspective view of an embodiment of a tamper-proof cap and container of the present invention.

A sealed and tamper-proof container 10 according to the invention comprises a tamper-proof screw cap 12 which inter-engages with the neck rib or lip 16 of a bottle 11. This is accomplished by welding to the cap 12 an annular snap rim 17 which serves as a sealing element. The welding of the annular snap rim 17 to the bottom of the cap 12 can be done in any conventional or unconventional way, including in the way described in parent co-pending application Ser. No. 058,679, the contents of which are incorporated by reference.

The cap 12 is of the "top-hat" style having a substantially tubular side wall 13 with internal threading **12*a* and an open bottom and a closed top wall 15. The "top-hat" appearance is provided by an integrally formed planar annular flange 18 surrounding the circumference of the tubular wall 13 in a plane parallel to the cap top wall 15, the flange 18 simulating the brim of a top-hat. In actual practice, however, the width of the annular flange 18** may be much smaller in relation to the remainder of the cap as compared to what is shown in the drawings.

Figure 6:
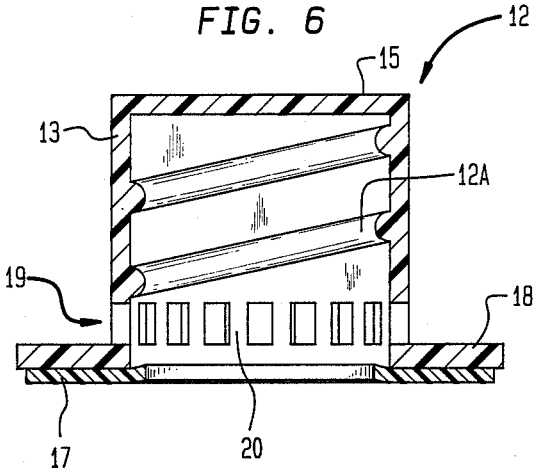
FIG. 6 is a cross-sectional view of the tamper-proof cap of the screw "top hat" type of the present invention taken along line 6—6 in FIG. 1.

A plurality of equidistantly spaced-apart, integrally formed, tear-away strips 20 are formed in a band 19 about the circumference of the tubular wall 13 at a location just above the flange 18; it will be understood, however, that the tear-away portion 19 may take a form other than the illustrated strips 20, e.g. a perforated zone or any other sufficiently weakened construction to permit separation upon twisting. The internally threaded region **12*a* is provided above the region 19 of the tear strips 20 as best shown in FIG. 6 and is provided for facilitating the refastening of the cap 12 to the container after the tear-away strips 20 have been broken. While the thickness of the cap 12 as illustrated in FIG. 6 is exaggerated, it will be understood that the tear strip zone 19** may be molded somewhat thinner than the remainder of the cap.

Welded to the bottom of the flange 18 is an annular snap rim 17 in the form of a generally planar disk which, however, preferably has a slightly frusto-conical figuration as best seen in FIG. 4 A. The outer diameter of the snap rim 17 is not critical except to the extent that it must be sufficiently great so that there is adequate surface area to provide a good, strong, substantially non-frangible weld with the undersurface of the flange 18 of the cap 12. On the other hand, the inner diameter of the annular snap rim 17 is critical so as to properly engage with the bottle in a tamper-proof manner as will be pointed out in more detail below.

The container 11, in the nature of a bottle, includes a substantially tubular open neck portion 14 externally threaded in the usual way. Located near the bottom of the neck portion 14 and below the threads is an integrally formed annular neck rib or lip 16 of the type normally found on both glass and plastic bottles. It should be understood that the vertical distance between the bottom of the neck rib 16 and the container opening should be substantially equal to the vertical distance between the bottom of the cap flange 18 and the bottom of the upper wall 15 of the cap 12.

Figure 4A:
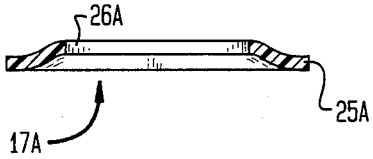
FIG. 4 A is a cross-sectional view of a first embodiment of an annular snap rim for use in the present invention as a sealing element.
Figure 4B:
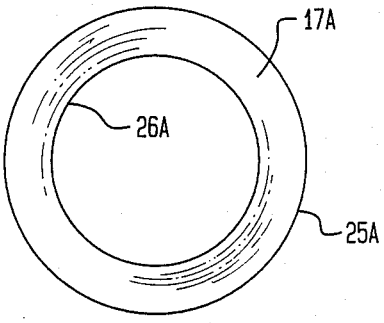
Figure 5:
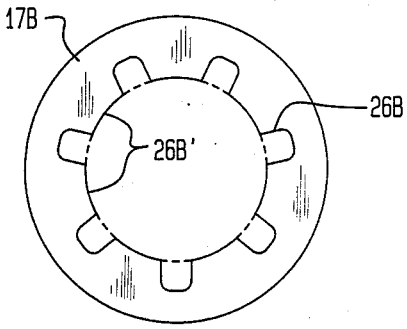
FIG. 5 is a plan view of a second embodiment of an annular snap rim in accordance with the present invention.

The annular snap rim 17 may take any of a number of different forms. Two forms are illustrated in FIGS. 4 and 5. In the snap rim 17 A of FIGS. 4A and 4B, the configuration provided is simply an annular disk with an outer edge 25A and an inner edge 26A, both of these edges being generally circular. As indicated above, it is preferred that the configuration be slightly frusto-conical as best shown in FIG. 4A with the outer edge 25A being at a first lower elevation and the inner edge 26A being at a second slightly higher elevation. In the snap rim 17B of FIG. 5, the inner edge 26B is provided with an irregular configuration which can be serrated, scalloped, or the like; again, at least a portion 26B′ of the inner edge 26B defines a circular configuration, the diameter of which (like the diameter of edge 26A of the snap rim 17A of FIG. 4) is selected so as to interlock beneath the neck rib 16 of the bottle 11. As with the annular snap rim 17A, the snap rim 17B also preferably has a crowned or elevated inner edge 26B′.

Tamper-proof cap 12, as well as snap rim 17, should be formed of rigid or semi-rigid plastic material which will not readily deform under handling forces and yet will permit the easy breaking of the frangible zone 19 when a normal hand turning force is applied to the cap 12. The material from which the cap 12 and snap rim 17 are formed must also be heat sealable, or at least the flange 18 and the snap rim 17 must be formed of heat sealable material or at the very least coated with such a material. Suitable heat sealable materials are known and include polyethylene, polypropylene, PVC, styrene polymers and copolymers, polyesters such as polyethylene terephthalate, etc. The cap 12 and snap rim 17 are formed to their predetermined shapes through the utilization of conventional molding methods such as injection molding, although the snap rim 17 can also be easily formed by extrusion and stamping.

Either prior to placement of the cap 12 on the bottle 11, or even subsequent thereto, the cap flange 18 may be welded and sealed to the snap rim 17 either ultrasonically or by heat. In the case where the snap rim 17 is first placed over the bottle neck and snapped into position below the neck rib 16, after which the cap 12 is applied, the snap rim 17 may be welded to the bottle flange 18 in precisely the same manner as disclosed in parent application Ser. No. 058,679. Similarly, when the snap rim 17 is welded to the annular flange 18 of the cap 12 prior to placement of the cap 12 on a suitable bottle 11, the welding technique may be selected among those which are known conventionally and those of the parent application Ser. No. 058,679.

Figure 7:
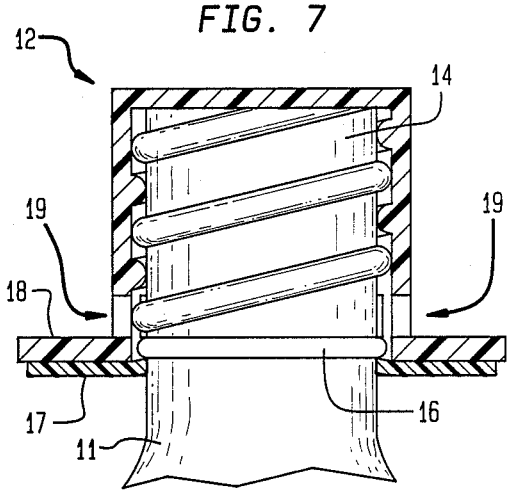
FIG. 7 is a cross-sectional view of a tamper-proof cap according to FIG. 6 in place on a bottle neck in a tamper-proof installation.

In those situations wherein the snap rim 17 is welded to the under surface of the cap flange 18 prior to application of the cap 12 to the bottle 11, such as shown in FIGS. 1 and 6, it will be understood that the cap 12 is merely screwed onto the neck portion 14 of the bottle 11 in the usual way, except that when the bottom portion of the snap rim 17 comes in contact with the upper portion of the neck rib 16 some additional screwing force is required whereby the inner edge of the snap rim 17 will flex upwardly, due to its inherent semi-rigidity, and will then snap down over the rib 16 as the cap 12 is advanced, whereby the snap rim 17 will come to rest at the position best shown in FIG. 7 with the top of the inner edge pressing upwardly against the bottom of the rib 16.

The provision of the crowned inner edge of the annular snap rim 17 thus provides a double function; first, its under surface provides a camming effect when the cap 12 is applied to its final position by camming over the neck rib 16. Second, after placement in the final locked position shown in FIG. 7, the upper surface of the inner edge of the snap rim 17 bears tightly against the bottom surface of the neck rib 16 to help ensure that the cap cannot be unscrewed without breaking the frangible zone 19 once it is snapped into place.

Figure 2:
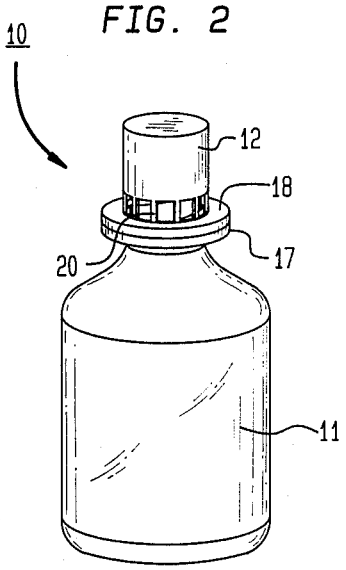
FIG. 2 is a perspective view of the container and tamper-proof cap sealed thereon.
Figure 3:
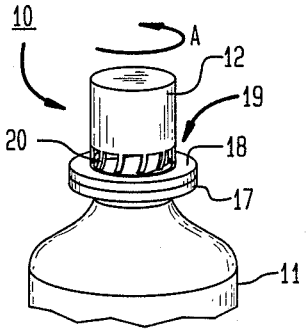
FIG. 3 is a partial perspective view of the tamper-proof cap/bottle showing removal of the cap to break the seal.

As illustrated in FIG. 3, after fixing of the cap in position as best shown in FIGS. 2 and 7, when one attempts to unscrew the cap this can only be achieved by breaking the cap along the frangible area 19. Thus, the cap 12 is removed and the seal is broken along the frangible zone 19 merely by rotating the cap 12 in the direction as indicated by arrow A in FIG. 3 thereby breaking the tear-away strips 20 and permitting unscrewing of the cap and access to the contents of the bottle 11. It should also be understood that while the cap 12 may be removed upon breaking of the tear-away strips 20, the flange 18 will remain connected to the snap rim 17 which will remain below the neck rib 16 of the container 11.

It should be understood that various caps and necks, as well as flange dimensions, may be employed to conform to bottles of various sizes and circumferences, as long as the vertical distances between the bottle top and neck rib are substantially equal to the vertical distance between the upper inner edge of the snap rim and the cap upper end so that the interlocking illustrated in FIG. 7 can be achieved.

While the present invention is directed to tamper-proof closures or caps of the tear-away strip type especially for use in conjunction with pharmaceutical containers, it should be understood that the present invention is intended to encompass all types of tamper-proof closures or closures per se for use with containers which might employ a closure thereon to alert potential users of pre-tampering. The present description is directed to pharmaceutical containers employing tamper-proof closures of the tear-away strip type merely for purposes of exemplification and to illustrate one use of the present invention.

It will be obvious to those skilled in the art that various changes may be made without departing from the scope of the invention and the invention is not to be considered limited to what is shown in the drawings and described in the specification.

What is claimed is:

1. A tamper-proof container, particularly useful for holding pharmaceutical products, comprising:

a tamper-proof internally threaded tubular cap having a closed upper end and an open bottom end, and a central axis, said bottom end including an integrally formed annular cap flange radially extending outwardly in a plane normal to said central axis and having a bottom surface;

a tear-away zone integrally formed about the periphery of said tubular cap just above said annular cap flange;

a bottle having a longitudinal axis, and an externally threaded neck portion having an open upper end, said neck including an integrally formed annular neck rib radially extending outwardly from said neck to define a lower rib surface, and an annular snap rim in the form of a generally planar disc having a slightly frusto-conical configuration with an outer diameter edge at a first elevation and an inner edge at a second elevation slightly higher than said first elevation, said annular snap rim being welded to said bottom surface of said cap flange, the inner edge of said snap rim engaging said lower rib surface of said bottle neck rib.

2. A tamper-proof container in accordance with claim 1, wherein the weld of said snap rim to said cap flange extends annularly around said flange.

3. A tamper-proof container in accordance with claim 1, wherein the weld of said snap rim to said cap flange comprises a plurality of straight weld seams.

4. A tamper-proof container in accordance with claim 1, wherein said tear-away zone comprises a plurality of vertically aligned tear-away strips connecting said cap flange to said tubular cap.

5. A tamper-proof container in accordance with claim 1, wherein said annular snap rim has a substantially circular inner edge.

6. A tamper-proof container in accordance with claim 1, wherein said snap rim has a serrated inner edge.

7. A tamper-proof closure, particularly useful for holding pharmaceutical products in a tamper-proof container, comprising:

a tamper-proof internally threaded tubular cap having a closed upper end and an open bottom end, and a central axis, said bottom end including an integrally formed annular cap flange radially extending outwardly in a plane normal to said central axis and having a bottom surface;

a tear-away zone integrally formed about the periphery of said tubular cap just above said annular cap flange; and an annular snap rim in the form of a generally planar disc having a slightly frusto-conical configuration with an outer edge at a first elevation and an inner edge at a second elevation slightly higher than said first elevation, said annular snap rim being welded to said bottom surface of said cap flange, the inner edge of said snap rim being adapted to engage a lower rib surface of a bottle neck rib onto which said cap is screwable to provide a tamper-proof container.

8. A tamper-proof closure in accordance with claim 7, wherein said annular snap rim has a substantially circular inner edge.

9. A tamper-proof container in accordance with claim 7, wherein said snap rim has a serrated inner edge.

10. A tamper-proof closure used in conjunction with a bottle to provide a tamper-proof bottle, comprising:

a tamper-proof internally threaded tubular cap having a closed upper end and an open bottom end, and a central axis, said bottom end including an integrally formed annular cap flange radially extending outwardly in a plane normal to said central axis;

a tear-away zone integrally formed about the periphery of said tubular cap just above said annular cap flange; and an annular snap rim in the form of a generally planar disc having a slightly frusto-conical configuration with an outer edge at a first elevation and an inner edge at a second elevation slightly higher than said first elevation, said annular snap rim being welded to a bottom surface of said cap flange, said tubular cap being screwed onto the neck of a bottle with the inner edge of said snap rim engaging a lower rib surface of a neck rib of the bottle.

11. A tamper-proof closure in accordance with claim 10, wherein said annular snap rim has a substantially circular inner edge.

12. A tamper-proof closure in accordance with claim 10, wherein said snap rim has a serrated inner edge.

* * * * *